US011526130B2

(12) United States Patent
Rombach et al.

(10) Patent No.: US 11,526,130 B2
(45) Date of Patent: Dec. 13, 2022

(54) POWER RESERVE INDICATOR MECHANISM FOR HOROLOGY

(71) Applicant: ETA SA Manufacture Horlogere Suisse, Grenchen (CH)

(72) Inventors: Stefan Rombach, Bienne (CH); Raphael Courvoisier, Corcelles (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 824 days.

(21) Appl. No.: 16/444,183

(22) Filed: Jun. 18, 2019

(65) Prior Publication Data

US 2020/0089169 A1 Mar. 19, 2020

(30) Foreign Application Priority Data

Sep. 19, 2018 (EP) ..... 18195540

(51) Int. Cl.
*G04C 10/04* (2006.01)
*G04B 1/10* (2006.01)
*G04B 9/00* (2006.01)

(52) U.S. Cl.
CPC ..... *G04B 9/005* (2013.01); *G04B 1/10* (2013.01); *G04B 9/00* (2013.01); *G04C 10/04* (2013.01)

(58) Field of Classification Search
CPC . G04C 10/04; G04B 1/10; G04B 9/00; G04B 9/005
See application file for complete search history.

(56) References Cited

U.S. PATENT DOCUMENTS 6,166,999 A * 12/2000 Jujo ..... G04B 9/005 368/203
6,685,352 B1 * 2/2004 Capt ..... G04B 13/008 368/210

(Continued)

FOREIGN PATENT DOCUMENTS

CN 101281386 A 10/2008
CN 105301941 A 2/2016

(Continued)

OTHER PUBLICATIONS

Combined Chinese Office Action and Search Report dated Nov. 4, 2020 in Chinese Patent Application No. 201910746068.7 (with English translation), 8 pages.

(Continued)

*Primary Examiner* — Edwin A. Leon
*Assistant Examiner* — Jason M Collins
(74) *Attorney, Agent, or Firm* — Oblon, McClelland, Maier & Neustadt, L.L.P.

(57) ABSTRACT

A power reserve indicator mechanism is for displaying the power reserve of an energy storage of a timepiece movement, powered in a winding phase by an input wheel actuated by a winding-stem or an automatic winding mechanism of the movement, or by an external winder, and arranged to restore energy in the unwinding phase via an output wheel. The power reserve indicator mechanism includes at least one display wheel set indirectly driven by the input wheel or by the output wheel, via a differential mechanism of which the input wheel and the output wheel (Continued)

constitute two inputs, and, at a single output, an output wheel set directly or indirectly driving the display wheel set.

10 Claims, 5 Drawing Sheets

(56) References Cited

U.S. PATENT DOCUMENTS

| | | | | |
|---|---|---|---|---|
| 9,367,040 | B2 * | 6/2016 | Reynard | G04B 9/005 |
| 2001/0024405 | A1 | 9/2001 | Jeanneret | |
| 2007/0195650 | A1 * | 8/2007 | Kamiya | G07C 3/045 368/223 |
| 2008/0205199 | A1 | 8/2008 | Watanabe | |
| 2008/0225646 | A1 * | 9/2008 | Zaugg | G04B 9/00 368/222 |
| 2011/0182152 | A1 | 7/2011 | Jouvenot | |
| 2011/0205857 | A1 * | 8/2011 | Beccia | G04B 5/16 368/208 |
| 2016/0018787 | A1 * | 1/2016 | Villar | G04B 9/00 368/220 |
| 2016/0349709 | A1 * | 12/2016 | Friedli | G04B 13/008 |
| 2018/0095424 | A1 * | 4/2018 | Saglini | G04B 3/043 |

FOREIGN PATENT DOCUMENTS

| | | | |
|---|---|---|---|
| CN | 105988355 | A | 10/2016 |
| CN | 106200341 | A | 12/2016 |
| EP | 1 970 778 | A1 | 9/2008 |
| EP | 2 977 828 | A1 | 1/2016 |
| EP | 3 098 668 | A1 | 11/2016 |
| JP | 39-29389 | | 10/1964 |
| JP | 2001-349962 | A | 12/2001 |
| JP | 2007-256255 | A | 10/2007 |
| JP | 2008-196884 | A | 8/2008 |
| JP | 2008-224668 | A | 9/2008 |
| JP | 2016-24196 | A | 2/2016 |

OTHER PUBLICATIONS

Japanese Office Action dated Jul. 7, 2020 in Japanese Application 2019-124947 (with English Translation), 7 pages.

European Search Report dated Mar. 1, 2019 in European Application 18195540.2, filed on Sep. 19, 2018 (with English Translation of Categories of Cited Documents).

* cited by examiner

POWER RESERVE INDICATOR MECHANISM FOR HOROLOGY

CROSS-REFERENCE TO RELATED APPLICATIONS

The present application claims priority to European Patent Application No. 18195540.2, filed on Sep. 19, 2018, the entire content and disclosure of which are incorporated by reference herein.

FIELD OF THE INVENTION

The invention concerns a power reserve indicator mechanism for horology, for displaying the power reserve of energy storage means of a timepiece movement, which energy storage means are arranged to be powered in a winding phase by an input wheel actuated by a winding-stem comprised in said movement or by a self-winding mechanism comprised in said movement or by an external winder, and are arranged to restore energy to said movement in an unwinding phase via an output wheel, said mechanism including at least one display wheel set arranged to be indirectly driven by said input wheel or by said output wheel, said mechanism including a differential mechanism of which said input wheel and output wheel constitute two inputs, and including, at a single output, an output wheel set which is arranged to directly or indirectly drive said display wheel set.

The invention also concerns a timepiece movement including at least one such mechanism.

The invention also concerns a watch including at least one such timepiece movement and/or at least one such mechanism.

The invention concerns the field of timepiece mechanisms, and of management of the energy storage of such mechanisms, particularly the display of the power reserve remaining in the drive means.

BACKGROUND OF THE INVENTION

The power reserve display of a mechanical watch is a useful function which makes it possible to avoid any untimely stopping of the watch due to lack of power, which might require the user to update the calendar or similar mechanisms, which is always tedious, and which also makes it possible to maintain the stored energy level in a range in which the delivered torque is substantially constant, thus allowing for optimum chronometry.

This function cannot always be positioned at will inside the watch case, since it is dependent upon the position of the energy transmission trains, and it is often difficult, in the case of a calendar watch or a watch with complications, to position all the displays optimally, with a minimum number of intermediate wheels, which take up space and use energy.

Patent No. EP2977828 in the name of ETA Manufacture Horlogère Suisse, discloses a power reserve indicator for horology for displaying the power reserve indication of a plurality of energy accumulators, each having one indicator cooperating with one input of a differential mechanism comprised in the power reserve indicator, and wherein one output of the differential mechanism cooperates with a mechanism for displaying the total power reserve of the plurality of energy accumulators, and at least two inputs are coaxial.

Patent No. EP1970778 in the name of MONTRES BREGUET discloses a timepiece which includes a power reserve indicator device with a differential frame which is disposed coaxially with respect to a barrel arbor. The secondary output of the differential is fixed to a cover. The differential gear output is obtained by an inner toothed crown which is kinematically connected to the primary input by the planetary wheels meshed with each other and carried by the cover.

SUMMARY OF THE INVENTION

It is an object of the invention to provide a simple, compact mechanism which allows the designer to arrange a power reserve indicator in any available place in a watch.

To this end, the invention concerns a power reserve indicator mechanism according to claim 1.

The invention also concerns a timepiece movement including at least one such mechanism.

The invention also concerns a watch including at least one such timepiece movement and/or at least one such mechanism.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
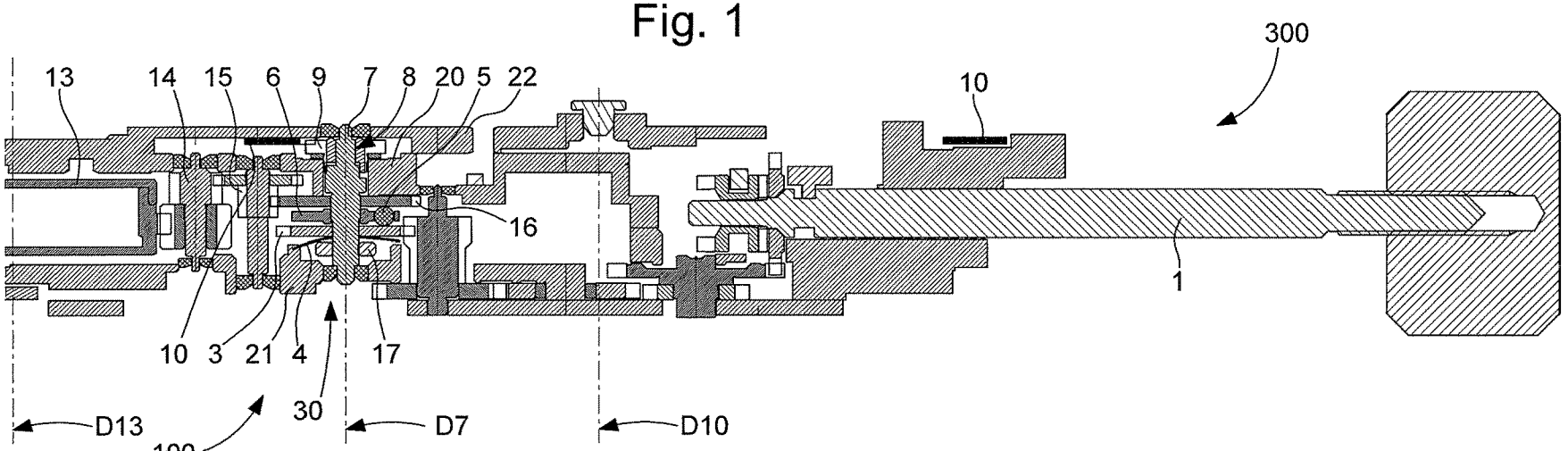
FIG. 1 represents a schematic sectional view through the main pivot axes of a power reserve indicator mechanism according to the invention, and the differential mechanism comprised therein.
Figure 3:
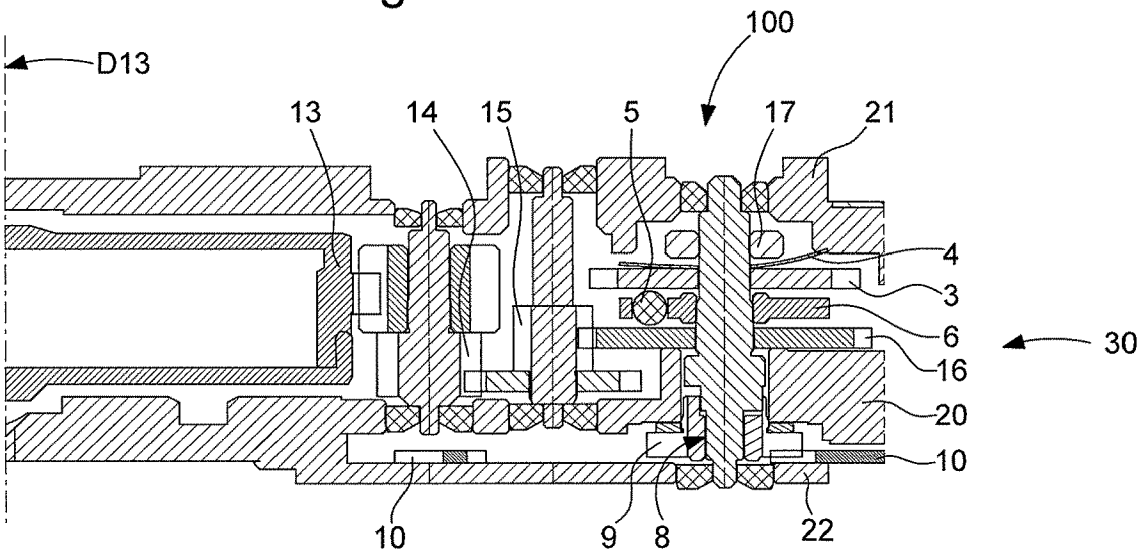
FIG. 3 represents, in a similar manner to FIG. 1, a detail of this mechanism, during the unwinding of a barrel, with the dial side in the bottom part of the Figure.
Figure 2:
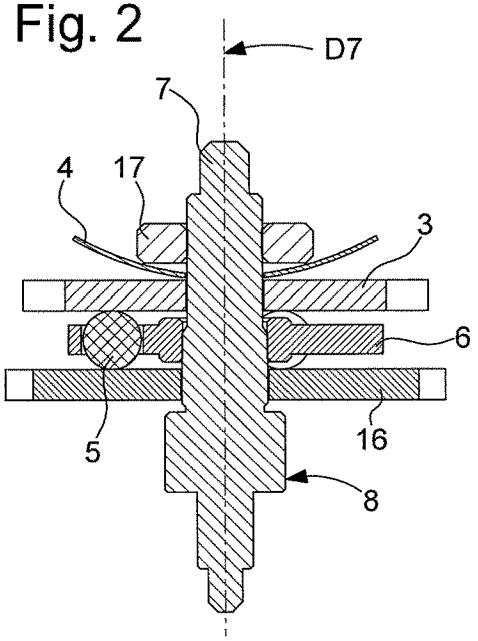
FIG. 2 represents, in a similar manner to FIG. 1, a detail of this mechanism, centred on the ball differential mechanism.
Figure 4:
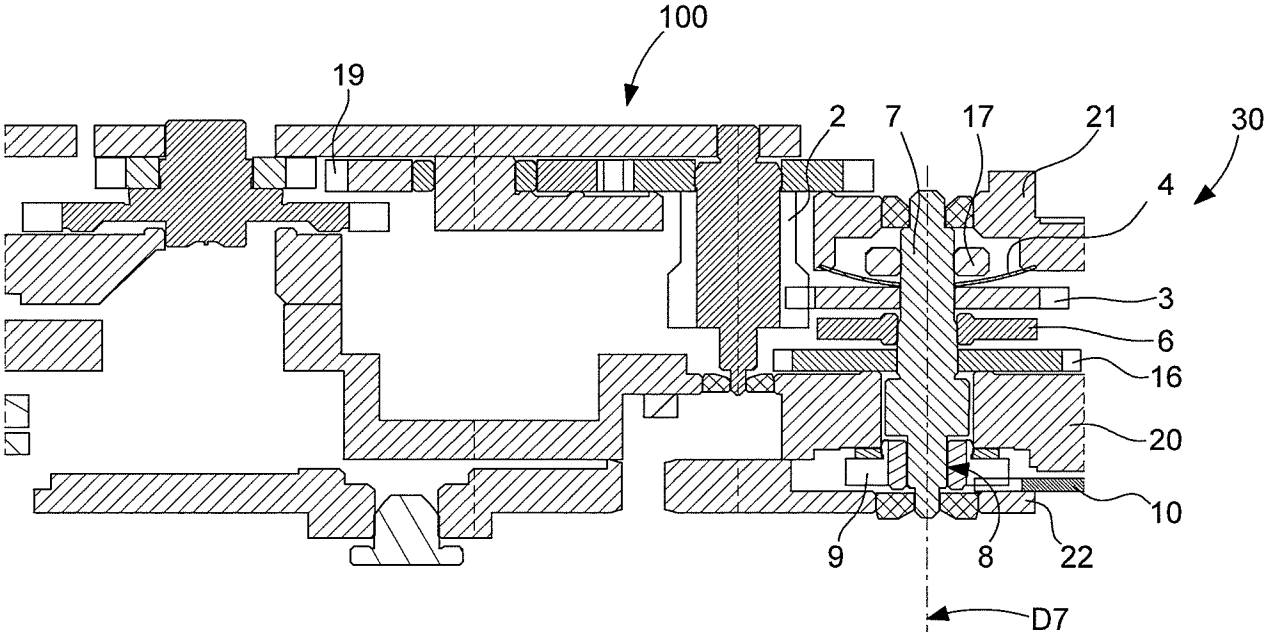
FIG. 4 represents, in a similar manner to FIG. 2, another detail of this mechanism, during winding, with the dial side in the bottom part of the Figure.

The invention concerns a power reserve indicator mechanism 100 for horology, for displaying the power reserve of energy storage means 200 of a timepiece movement 300.

These energy storage means 200, such as a barrel or suchlike, are arranged to be powered in a winding phase by an input wheel 2. This input wheel 2 is actuated by a winding-stem 1 comprised in movement 300, or by an automatic self-winding mechanism 400 comprised in movement 300, or by an external winder.

Energy storage means 200 are arranged to restore energy to movement 300 in an unwinding phase via an output wheel 14.

Mechanism 100 includes at least one display wheel set 10 or 12, arranged to be indirectly driven by input wheel 2 or by output wheel 14.

According to the invention, mechanism 100 includes a differential mechanism 30 of which input wheel 2 and output wheel 14 constitute two inputs, and including, at a single output, an output wheel set 9 which is arranged to directly or indirectly drive display wheel set 10 or 12.

More particularly, and as seen in the Figures, differential mechanism 30 is a friction ball differential mechanism, including a first wheel 3 directly or indirectly meshing with input wheel 2, and a second wheel 16 parallel to first wheel 3 and directly or indirectly meshing with output wheel 14. This differential mechanism 30 also includes ball bearings 5 which are arranged to roll between first wheel 3 and second wheel 16, under the action of friction means 4, which are arranged to push first wheel 3 and second wheel 16 towards one another, by driving while rolling a carrier 6 which contains ball bearings 5 and which is arranged to drive output wheel set 9.

More particularly, first wheel 3 and second wheel 16 are coaxial.

More particularly still, first wheel 3 and second wheel 16 are coaxial to carrier 6 which is secured to output wheel set 9, which is secured to an arbor 7 carrying first wheel 3 and second wheel 16.

In the non-limiting variant illustrated by the Figures, friction means 4 include at least one elastic member resting, on the one hand, on a plate 20 or a bridge 21 or 22 comprised in mechanism 100 or movement 300, and on the other hand, on first wheel 3 in the variant of the Figures, or on second wheel 16.

FIG. 1 shows these friction means 4 in the form of a warped spring resting on barrel bar 21. A washer 17 is driven onto differential arbor 7, which carries carrier 6 and output wheel set 9 for driving display wheel set 10 or 12. First wheel 3 and second wheel 16 pivot about this arbor 7. This washer 17 holds spring 4 and allows balls 5 to be held inside carrier 6, between first wheel 3 and second wheel 16.

In a particular variant, mechanism 100 includes a first display wheel set visible on a first side of a plate 20 or of a bridge 21 or 22 comprised in mechanism 100 or movement 300, and a second display wheel set visible on a second side opposite the first side.

According to the invention, a display wheel set is a display wheel 12, which is directly or indirectly driven by a toothed ring 10 which meshes with output wheel set 9, and the pivot axis of this display wheel 12 is internal or external to ring 10 inside which pivot the wheel sets of differential mechanism 30.

Figure 7:
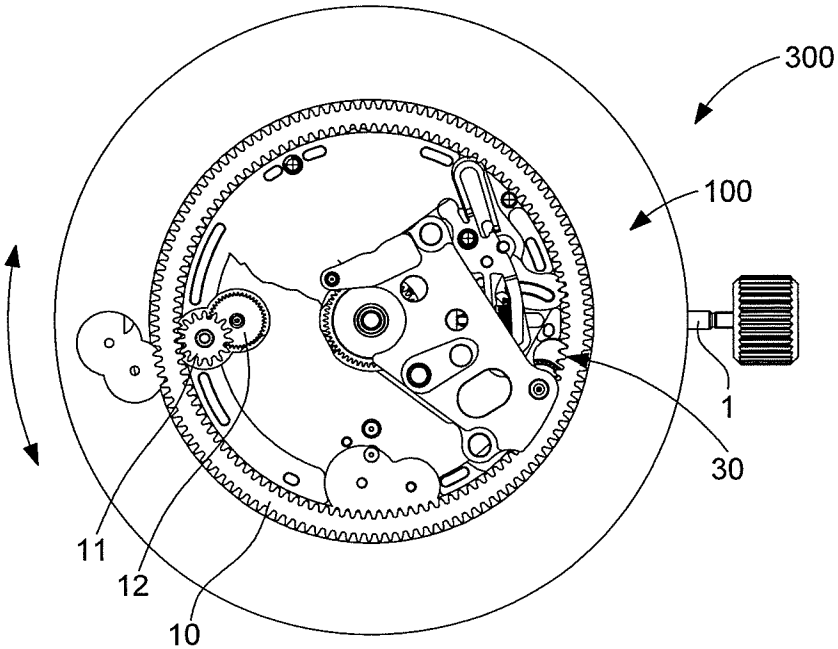
FIG. 7 represents, in a similar manner to FIG. 6, one such movement, with the toothed ring that drives a display wheel mounted internally to this ring.
Figure 6:
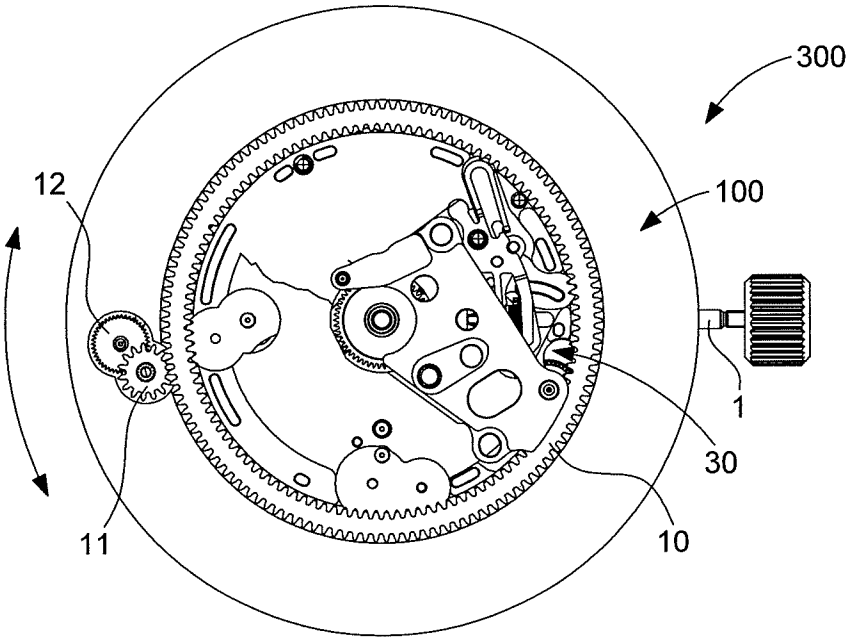
FIG. 6 represents a schematic partial plan view of a movement including a power reserve indicator mechanism according to the invention, comprising a toothed ring which drives a display wheel mounted externally to this ring.
Figure 9:
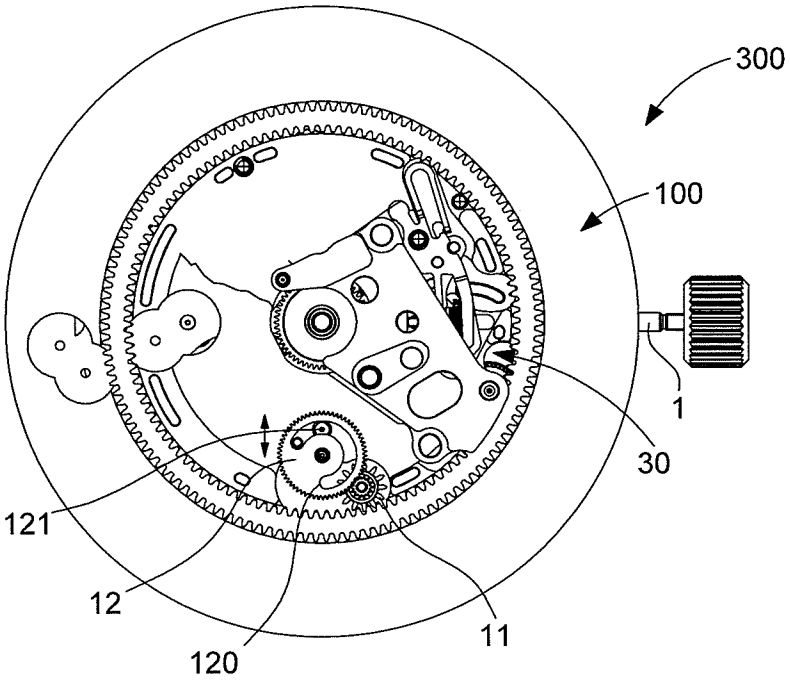
FIG. 9 represents, in a similar manner to FIG. 8, one such mechanism with the toothed ring that drives a display wheel mounted internally to this ring, on the six o'clock/twelve o'clock axis, wherein the display wheel includes an eyelet for limiting its angular travel, this display wheel is arranged very close to the toothed ring, and this arrangement also allows for various display angles.
Figure 8:
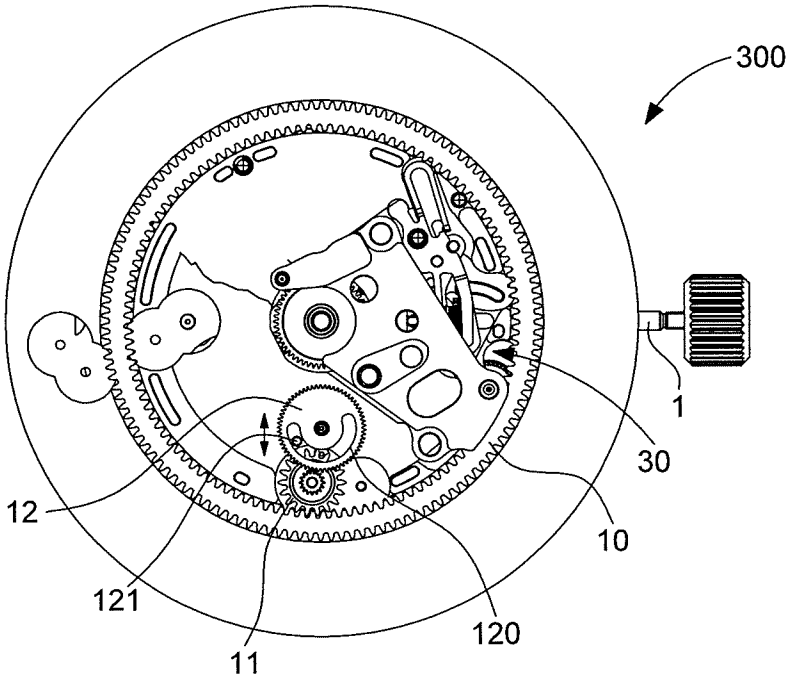
FIG. 8 represents, in a similar manner to FIG. 7, one such mechanism with the toothed ring that drives a display wheel mounted internally to this ring, on the six o'clock/twelve o'clock axis, wherein the display wheel includes an eyelet for limiting its angular travel, this display wheel is arranged very close to the centre of the movement, and this arrangement allows for various display angles.
Figure 13:
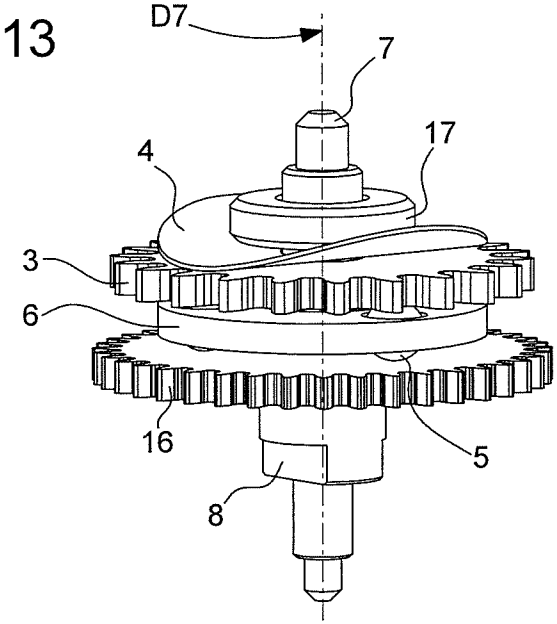
FIG. 13 shows a schematic, perspective view of the axial part of the differential mechanism, illustrated in a sectional view in FIG. 2.
Figure 14:
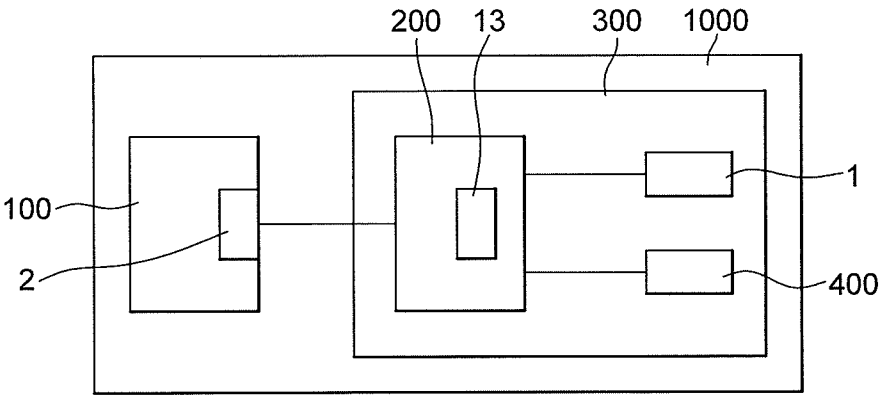
FIG. 14 is a block diagram representing a watch including a movement with energy storage means, and such a power reserve indicator mechanism.
Figure 11:
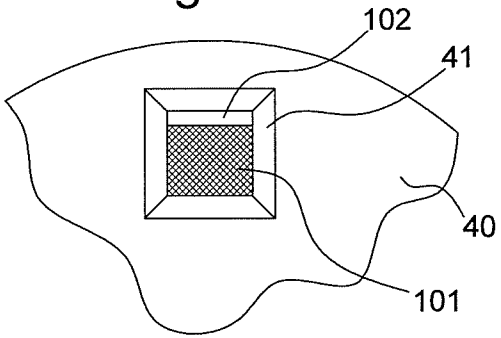
FIGS. 11 and 12 are two representations of the ring of FIG. 10 in the aperture of a dial, respectively at the end of unwinding and at the start of unwinding.
Figure 10:
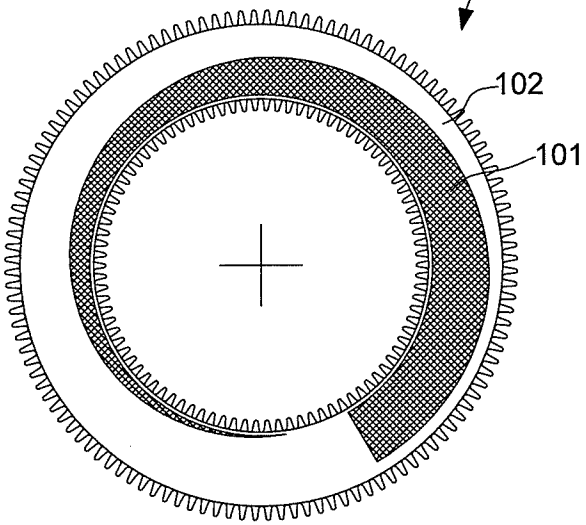
FIG. 10 represents a partial schematic plan view of a toothed ring which includes, on a light coloured background, a contrasting spiral marking, in order to display the remaining power reserve in an aperture.
Figure 12:
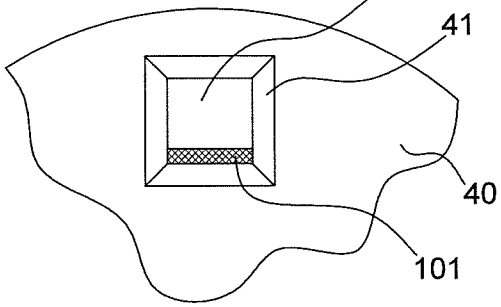

FIGS. 6 to 9 show an internally and externally toothed ring, which allows the designer to choose to position a display wheel 12 on the exterior of this ring, as in FIG. 6, or on the interior of this ring, as in FIGS. 7 to 9.

Figure 5:
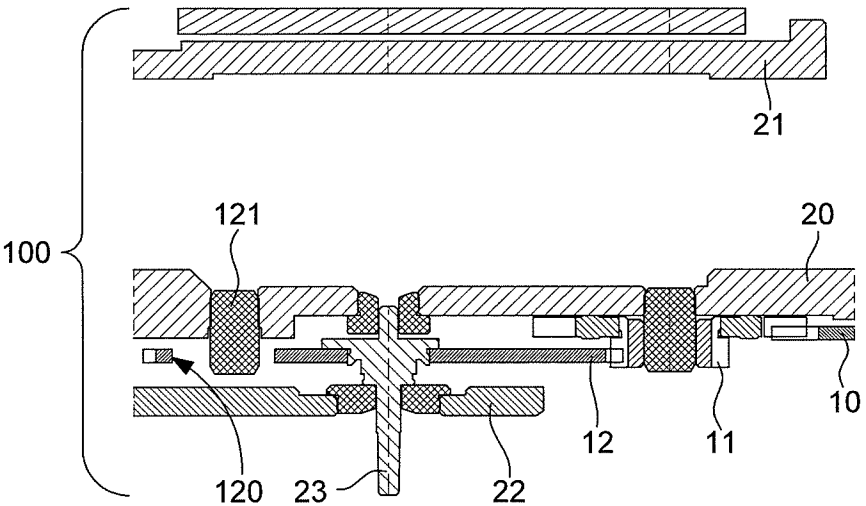
FIG. 5 represents, in a similar manner to FIG. 1, yet another detail of this mechanism, with limitation of the travel of a display wheel which includes an eyelet cooperating with a fixed pin.

In a particular variant, visible in FIGS. 5, 8 and 9, display wheel 12 includes an eyelet 120 which cooperates with a pin 121 which is fixed on a plate 20, or on such a bridge 21 or 22, to limit the angular travel of display wheel 12 which is pivoted by its arbor 23 between plate 20 and a bridge 22 or a dial 40.

In a similar embodiment of the invention, a display wheel set is directly formed by a toothed ring 10 which meshes with output wheel set 9, inside which ring 10 pivot the wheel sets of differential mechanism 30. More particularly, this display wheel set forms a power reserve display, and this ring 10 advantageously bears a gradual marking 101 on at least one of its plane surfaces, contrasting with a light coloured background 102, arranged to display the remaining power reserve in an aperture 41 of a dial 40.

The invention also concerns a timepiece movement 300 including at least one such power reserve indicator mechanism 100. More particularly, this movement 300 includes at least one dial 40, a plate 20 and at least one bridge 21 or 22, arranged to support differential mechanism 30, and including a plurality of arrangements each able to receive a display wheel 12 according to the first variant, in different angular positions of dial 40. It is thus very easy to arrange a power reserve indicator at will in any area of the dial. And, in the second variant, more particularly, movement 300 includes a plate 20 and at least one bridge 21 or 22, arranged to support differential mechanism 30, and dial 40 includes an aperture 41 for displaying gradual marking 101.

The operation of the mechanism is simple:

during winding, by means of winding-stem 1 of the watch, or other energy supply means, input wheel 2 turns first wheel 3; as a result of the friction imparted by spring 4, first wheel 3 rotates ball bearings 5, thereby also driving carrier 6 which contains these ball bearings 5. This carrier 6 is pressed onto differential arbor 7, which drives, via a square 8 comprised therein, output wheel set 9, which drives first display wheel set 10, which in turn drives an intermediate drive wheel 11, which drives second display wheel set 12, which indicates the instantaneous power reserve angle;

during unwinding, an energy storage means 200, such as a barrel 13, drives output wheel 14, which rotates an intermediate differential wheel 14, which drives differential drive wheel 15, which rotates second wheel 16, which causes ball bearings 15 and thus their carrier 16 to rotate, and therefore differential arbor 7, and, as with during winding, the cascade of gear trains with first display wheel set 10 and second wheel set 12.

Naturally the invention is applicable to the power reserve display of energy sources specific to the movement, but also to associated functionalities, such as a striking mechanism, or a music box or otherwise.

The invention also concerns a watch 1000 including at least one such movement 300, and/or at least one such power reserve indicator mechanism 100.

This design offers the possibility of easily displaying the power reserve over 360°, in any appropriate area of the dial or of the watch movement.

The invention claimed is:

1. A power reserve indicator mechanism for horology, for displaying the power reserve of energy storage means of a timepiece movement, which energy storage means are arranged to be powered in the winding phase by an input wheel actuated by a winding-stem comprised in said movement or by an automatic winding mechanism comprised in said movement or by an external winder, and are arranged to restore energy to said movement in the unwinding phase via an output wheel, said power reserve indicator mechanism comprising:

at least one display wheel set arranged to be directly or indirectly driven by said input wheel or by said output wheel, a differential mechanism of which said input wheel and said output wheel constitute two inputs, and including, at a single output, an output wheel set which is arranged to directly or indirectly drive said display wheel set, wherein one said display wheel set is a display wheel directly or indirectly driven by a toothed ring which meshes with said output wheel set, and the pivot axis of said display wheel is external to said ring, and the input wheel set of said differential mechanism pivots inside of said ring.

2. The power reserve indicator mechanism according to claim 1, wherein said differential mechanism is a friction ball differential mechanism, including a first wheel directly or indirectly meshing with said input wheel, and a second wheel parallel to said first wheel and directly or indirectly meshing with said output wheel, and ball bearings which are arranged to roll between said first wheel and said second wheel under the action of friction means which are arranged to push said first wheel and said second wheel towards one another, driving while rolling a carrier which contains said ball bearings and which is arranged to drive said output wheel set.

3. The power reserve indicator mechanism according to claim 2, wherein said first wheel and said second wheel are coaxial.

4. The power reserve indicator mechanism according to claim 3, wherein said first wheel and said second wheel are coaxial to said carrier, which is secured to said output wheel set, which is secured to an arbor carrying said first wheel and said second wheel.

5. The power reserve indicator mechanism according to claim 2, wherein said friction means include at least one elastic member resting on a plate or a bridge comprised in said mechanism or said movement.

6. The power reserve indicator mechanism according to claim 1, wherein said mechanism includes a first display wheel set visible on a first side of a plate or of a bridge comprised in said mechanism or said movement, and a second display wheel set visible on a second side opposite to said first side.

7. The power reserve indicator mechanism according to claim 1, wherein said display wheel includes an eyelet which cooperates with a pin fixed to a plate or a bridge comprised in said mechanism or said movement to limit the angular travel of said display wheel.

8. A timepiece movement, comprising:

at least one of the power reserve indicator mechanism according to claim 1;

at least one dial; and a plate and at least one bridge arranged for supporting said differential mechanism and including a plurality of arrangements each able to receive a said display wheel, in different angular positions of said dial.

9. A watch, comprising:

the timepiece movement according to claim 8.

10. The power reserve indicator mechanism according to claim 1, wherein said display wheel is directly driven by said toothed ring which meshes with said output wheel set.

* * * * *